US005228404A

United States Patent [19]

Gibbs

[11] Patent Number: 5,228,404

[45] Date of Patent: Jul. 20, 1993

[54] CATAMARAN SUSPENSION SYSTEM

[76] Inventor: Louis L. Gibbs, 4640 Lakeview Dr., Gainesville, Ga. 30504

[21] Appl. No.: 920,798

[22] Filed: Jul. 28, 1992

[51] Int. Cl.[5] ..... B63B 1/22

[52] U.S. Cl. ..... 114/61; 114/283

[58] Field of Search ..... 114/56, 57, 61, 274, 114/276, 278, 279, 280, 281, 282, 270, 283, 284

[56] References Cited

U.S. PATENT DOCUMENTS

| | | | |
|---|---|---|---|
| 1,369,670 | 2/1921 | Kauffman . | |
| 1,683,276 | 9/1928 | Woods . | |
| 2,678,018 | 5/1954 | Crisp | 114/123 |
| 2,876,728 | 3/1959 | Luger | 114/61 |
| 3,002,484 | 10/1961 | Dube | 114/61 |
| 3,016,864 | 1/1962 | Woodfield | 114/61 |
| 3,517,632 | 6/1970 | Gray | 114/61 |
| 3,528,380 | 9/1970 | Yost | 114/66.5 |
| 3,952,234 | 9/1970 | Levinson | 114/43.5 |
| 3,998,176 | 12/1976 | Stout et al. | 114/61 |
| 4,351,262 | 9/1982 | Matthews | 114/61 |
| 4,457,248 | 7/1984 | Thurston | 114/39 |
| 4,688,504 | 8/1987 | Sulz et al. | 114/39 |
| 4,730,571 | 3/1988 | Hedlund et al. | 114/61 |
| 4,763,594 | 8/1988 | Zickermann | 114/61 |
| 4,802,428 | 2/1989 | Lang | 114/61 |
| 5,038,697 | 8/1991 | Farrier | 114/61 |
| 5,107,783 | 4/1992 | Magazzu | 114/123 |

*Primary Examiner*—David M. Mitchell
*Assistant Examiner*—Stephen P. Avila
*Attorney, Agent, or Firm*—Kennedy & Kennedy

[57] ABSTRACT

A catamaran suspension system is mounted between the deck (16) and hulls (11) of a catamaran (10). The suspension system has a pair of tracks (31), (32) mounted to the deck on which carriages (33) having a shock absorber (38) are movably mounted. A pivotable arm (44) is mounted between each carriage and a hull of the catamaran with a strut (50) pivotably mounted between the arm and deck. The suspension system dampens the forces exerted on the hull through the movement of the carriages to minimize deck movement.

8 Claims, 5 Drawing Sheets

CATAMARAN SUSPENSION SYSTEM

TECHNICAL FIELD

This invention relates to shock absorbing suspension systems for catamarans.

BACKGROUND OF THE INVENTION

Today there exists a vast number of boats. Many boats have what is commonly referred to as a V-shaped hull. These hulls typically require a large amount of energy to propel them through water due to the sizable amount of hull surface area in contact with the water. Additionally, small and medium sized boats of this design have a tendency to roll and pitch when subjected to waves causing discomfort to boat occupants.

Catamarans incorporate a pair of laterally spaced hulls bridged by a deck. The area of hull surface in contact with the water is considerably diminished as compared with single hull boats of similar capacity, which reduces drag. Another advantage of catamarans is that they typically plunge through swells and choppy water rather than riding over them which provides a smoother ride than single hulled boats. Nevertheless, catamarans can still roll, pitch and impact waves sufficiently to produce a jarring and uncomfortable ride. Boats have also been designed which incorporate suspension systems to reduce the discomfort experienced by boat occupants caused by the impact of waves as illustrated in U.S. Pat. Nos. 3,002,484 and 3,528,380. These types of boats typically have pontoons or outriggers coupled to a main hull through a suspension system having shock absorbers. However, waves may still cause these boats to pitch or roll from side to side and jar passengers.

It thus is seen that a need remains for a catamaran with an improved shock absorbing suspension system. Accordingly, it is to the provision of such therefore that the present invention is primarily directed.

SUMMARY OF THE INVENTION

In a preferred form of the invention, a suspension system for a catamaran having two hulls and a deck comprises a track adapted to be mounted to the deck, first and second carriages movably mounted upon the track, and limiting plate for limiting movement of said carriages. Shock absorbers mounted between the carriages and the limiting plates dampen force exerted upon the carriages as they are driven towards the limiting plates. A first elongated arm is pivotably mounted at one end to one hull and pivotably mounted at an opposite end to the first carriage. A second elongated arm is pivotably mounted at one end to the other hull and pivotably mounted at an opposite end to the second carriage. A first strut is pivotably mounted at one end to the one arm and pivotably mounted at an opposite end to the deck, and a second strut is pivotably mounted at one end to the second arm and pivotably mounted at an opposite end to the deck.

BRIEF DESCRIPTION OF THE DRAWING

FIG. 1A is a side view of a catamaran that embodies principles of the invention in a preferred form, shown in a lowered configuration, while

FIG. 2A is a side view of the catamaran of FIG. 1 shown in a lifted configuration with a side panel removed for clarity, while

FIG. 3A is a side view of the catamaran of FIG. 1 shown in a lifted configuration with one hull canted down and one hull canted up and with both side panels removed for clarity, while

DETAILED DESCRIPTION

Figure 1A:
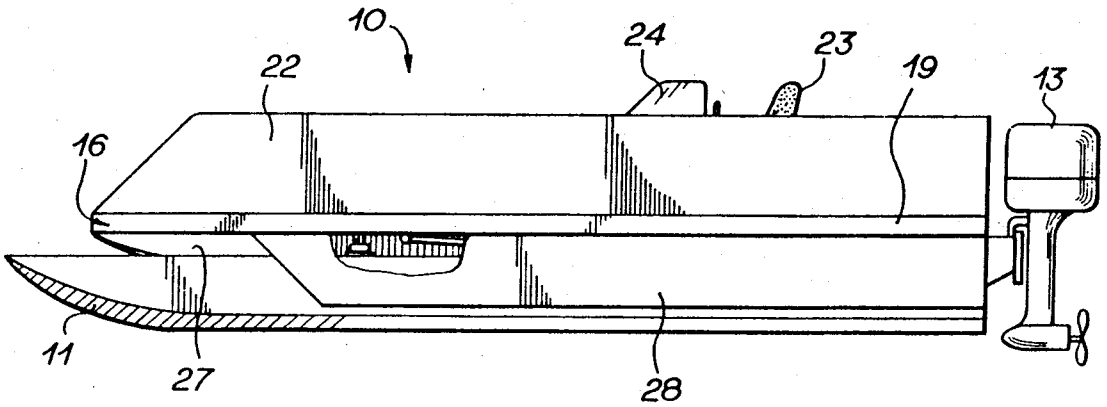

With reference next to the drawings, there is shown a catamaran 10 having two laterally spaced hulls 11, a motor pod 12 positioned between the hulls 11, a motor 13 mounted to the motor pod 12, a deck 16 and a suspension system 17 mounted between the deck 16 and the hulls 11. The term catamaran is meant to include various types of boats that have more than one hull such as trimarans and pontoon boats. The deck 16 has a rectangular frame 19 on which is mounted a flooring 20, a front shield 21 and side shields 22. A driver's seat 23 and driving console 24 are mounted upon the flooring 20. A bow shaped wave breaker 27 is mounted beneath the front of the deck to prevent the deck from submerging beneath large waves and to divert water towards the sides of the catamaran. Side panels 28 depend from either side of the frame to hide the suspension system 17 from view and to enhance structural strength to the frame. The suspension system 17 has a front suspension assembly 29 and a rear suspension assembly 30.

Figure 6:
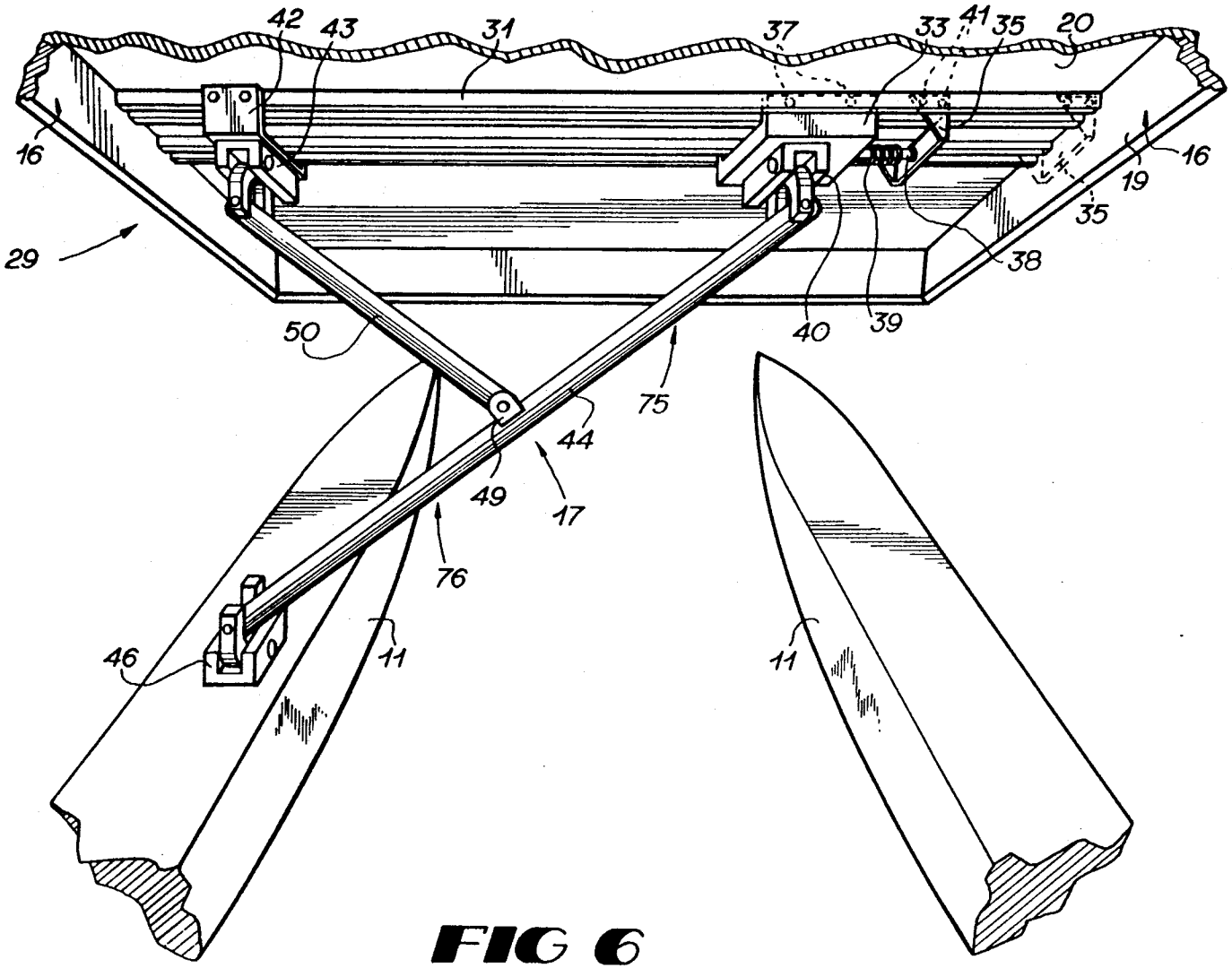
FIG. 6 is a perspective view of a front portion of the catamaran of FIG. shown with portions of the front suspension system assembly and side panels removed for clarity.

With reference next to FIG. 6, there is shown the front suspension assembly 29 having a front track 31 mounted to the underside of the front portion of the deck. For purposes of clarity only one component of each pair of components of the front suspension assembly hereafter described is shown in FIG. 6. It should however be understood that the omitted components are merely mirror images of those shown. The front suspension assembly 29 has a pair of spring biased carriages 33 and a pair of repositionable limiting plates 35, all movably supported for travel upon the front track 31 The carriages 33 have four wheels 37 rollably positioned upon the track 31, a damper or shock absorber 38 having one end coupled to the limiting plate 35, and a coil spring 39 positioned about the shock absorber 38 in abutment with the limiting plate 35 to bias the carriage away from the limiting plate 35. A pivot joint 40 is mounted to the underside of each carriage 33.

The limiting plates 35 have four wheels 41 rollably positioned upon the track 31. An unshown hydraulic cylinder is coupled to the limiting plates 35 to position them along the track. A pair of U-shaped brackets 42 is fixedly mounted to the outside of opposite ends of the track 31. A pivot joint 43 is mounted to the underside of each U-shaped bracket 42. An elongated arm 44 is pivotably mounted at one end to each pivot joint 40 and pivotably mounted at its other end to each pivot joint 46 mounted to the hull on the opposite side of the catamaran from pivot joint 40 and located below U-shaped bracket 42. A pivot bracket 49 is mounted to the center of each arm 44. A strut 50 is pivotably mounted at one end to each pivot joint 43 and pivotably mounted at its other end to a pivot bracket 49.

Figure 5:
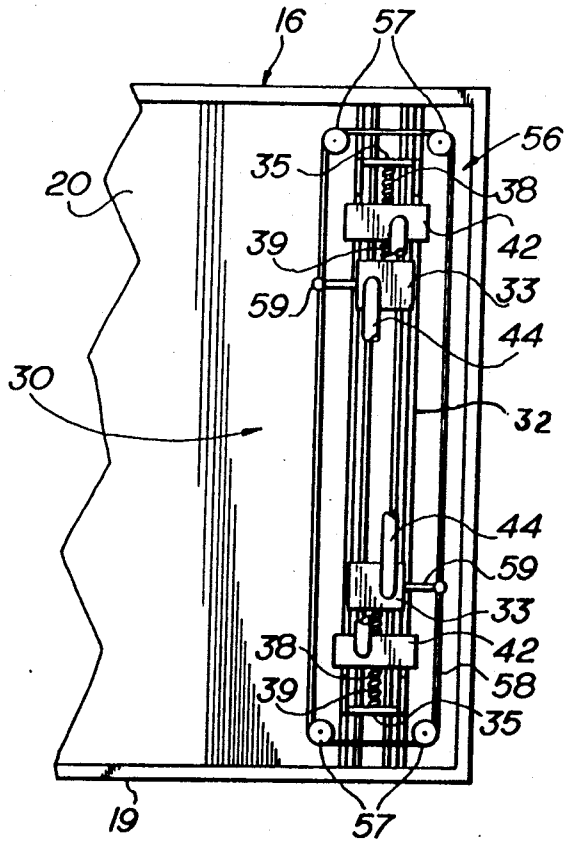
FIG. 5 is a schematic bottom view of a portion of the deck and suspension system of the catamaran of FIG. 1.

The rear suspension assembly 30 is substantially the same as the front suspension assembly 29 with the exception of the inclusion of connecting means which synchronize movement of the carriages 33 of the rear suspension assembly. The rear suspension assembly 30 has a rear track 32 mounted to the underside of a rear portion of the deck 16. As shown in FIG. 5, the connecting means has four rollers 57 mounted to the underside of the deck and an endless loop cable 58 bearing on the rollers 57. Additionally, each carriage of the rear suspension assembly has a coupler arm 59 which couples each carriage with the cable 58. The carriages are coupled to opposite sides of the looped cable so that as the cable moves about the rollers the carriages move in sync towards or away from each other.

Figure 2A:
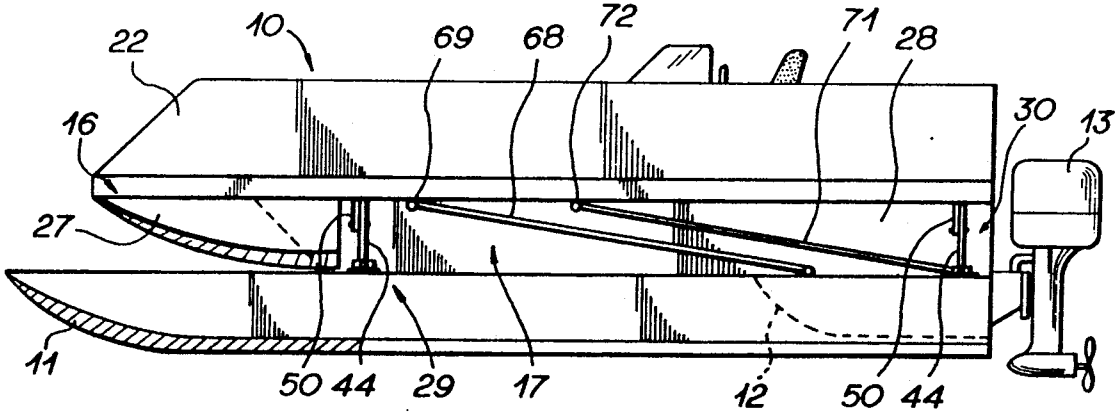
Figure 2B:
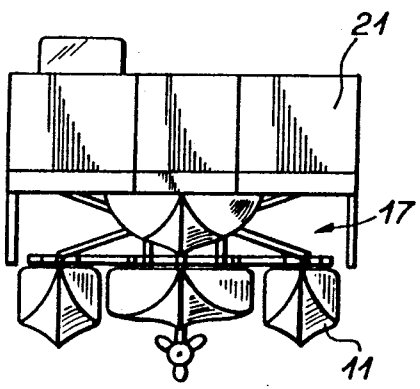
FIG. 2B is a front view thereof.
Figure 4:
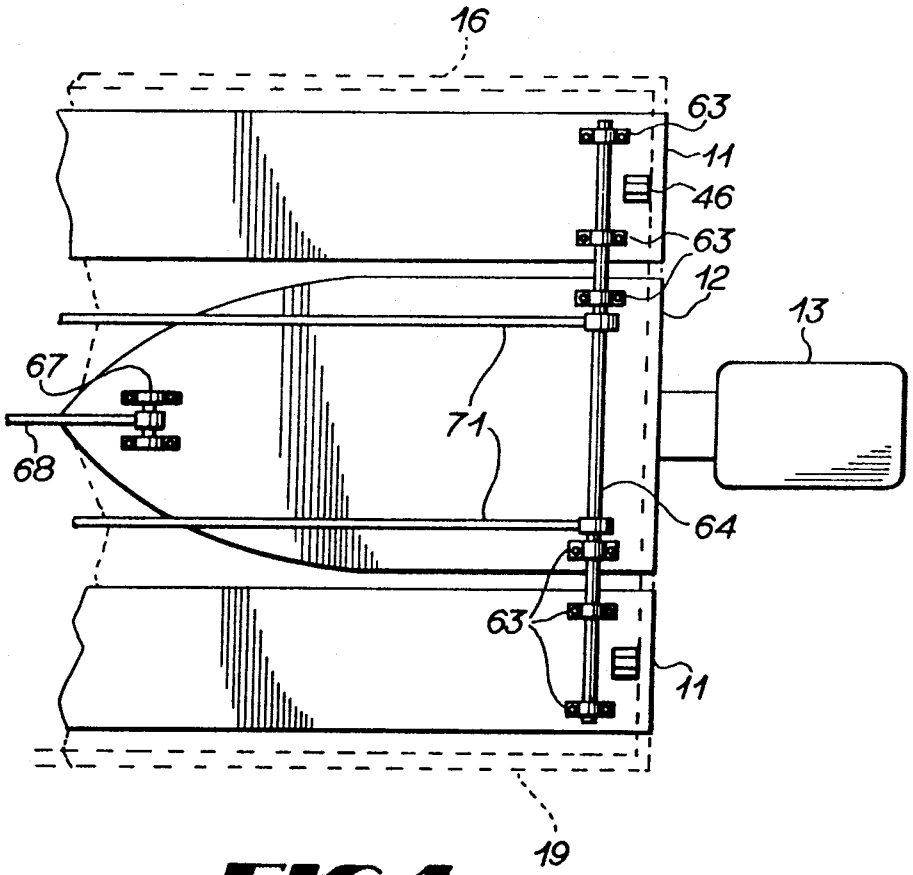
FIG. 4 is a top view of a portion of the catamaran of FIG. 1 shown with the deck illustrated in phantom lines for clarity.

Referring next to FIG. 4, the suspension system also has coupling means for coupling the motor pod 12 to the hulls 11 and for coupling the motor pod 12 to the deck 16. The coupling means has two bearings 63 mounted to the top of each hull proximate its rear and two bearings 63 mounted to the top of the motor pod proximate its rear. A rod 64 is journaled through each bearing 63 to maintain the hulls and motor pod laterally aligned with each other while allowing the motor pod and each hull to pivot about the rod independently. A pillow block 67 is mounted atop the motor pod proximate its front to which a connecting rod 68 is pivotably coupled at one end and pivotably coupled at its opposite end to a pillow block 69 mounted to the underside of the deck, all as shown in FIG. 2A. Two connecting rods 71 are pivotably coupled at one end to rod 64 and pivotably coupled at their opposite ends to a pillow block 72 mounted to the underside of the deck. Connecting rods 68 and 71 are mounted parallel to each other in order to maintain the motor pod parallel to the deck 16, similarly to the operation of parallel rulers.

OPERATION

Figure 1B:
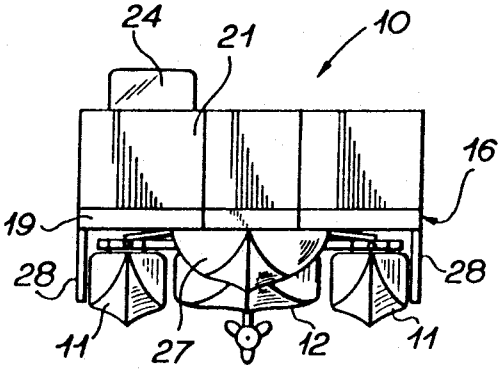
FIG. 1B is a front view thereof.
Figure 7:
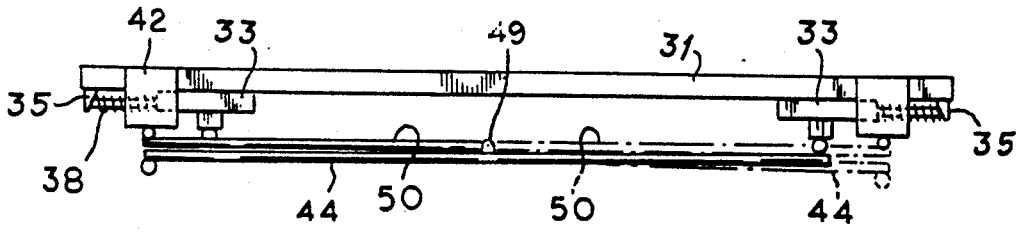
FIG. 7 is a schematic rear elevational view of the front suspension system assembly shown in a collapsed configuration.

Referring next to FIGS. 1A, 1B and 7, the catamaran 10 is shown in a lowered configuration with the suspension system collapsed in its inoperable position for storage. This configuration is achieved by positioning the limiting plates 35 to their extreme outward limits, as shown in phantom lines in FIG. 6, which in turn positions the carriages 33 to their extreme outward position. Here, the arms 44 and struts 50 are collapsed to lay substantially flat.

To lift the deck to a raised configuration, as shown in FIG. 2A–3B and 8, the limiting plates are hydraulically moved inward along their tracks to their deck raised position, as shown in FIG. 6. The inward movement of the carriages 33 forces the arms to pivot upward about pivot joint 46 so that the ends of the arms 44 coupled to the carriages move upward and toward each other, i.e. to an inclined position. The inclination of the arms forces the deck upwardly away from the hulls.

Once the deck is lifted to a raised configuration the weight of the deck and the deck load is supported by the suspension system with the carriages forced to an equalized position. Thereafter, forces exerted on the hull, which cause the hull to move towards the deck, are absorbed by the suspension system through the compression of the shock absorber 38 and spring 39.

Figure 9:
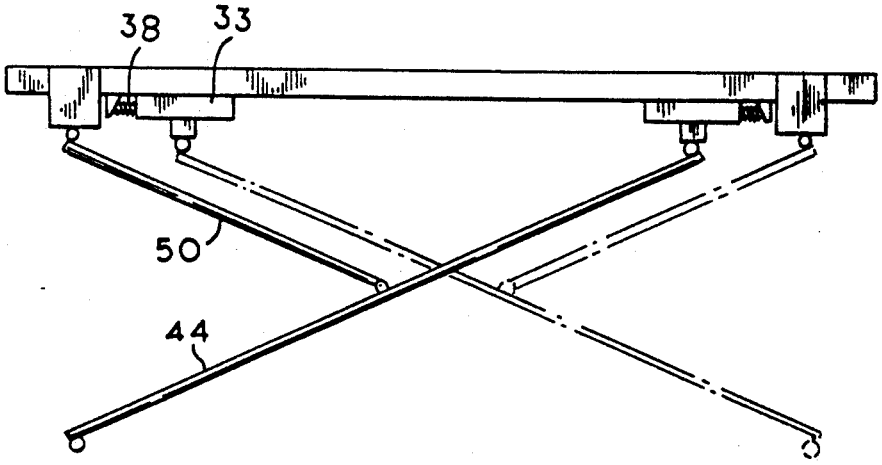
FIG. 9 is a schematic rear elevational view of the front suspension system assembly shown somewhat compressed.

For example, the upward movement of a hull towards the deck forces the carriage 33 towards the limiting plate 35 through the pivoting of the arm 44 to a leveler position with respect to the hull and deck, as shown in FIG. 9. The movement of the carriage compresses the shock absorber 38 and spring 39, thereby dampening the force exerted on the hull. As the arm moves to a leveler position its corresponding strut 50 also pivotably moves to a leveler position. The simultaneous movement of the arm and strut maintains the deck in a level position, as describe in more detail hereafter. The spring 39 then rebounds the carriage arms and struts to their initial, equalized position. Thus, it should be understood that the upward force exerted on the hull is not only dampened but also redirected outwardly along the deck to minimize the jolting of the deck. Conversely, the downward movement of the hull away from the deck allows the spring 39 to force the carriage away from the limiting plate and the arm 44 to pivotably move to a more upright position. As the arm pivots upwards the corresponding strut also pivots to a more upright position to maintain the deck level. The shock absorber limits the amount and speed of the downward movement of the hull to prevent jolting the deck downward towards the hulls. Thus, the hull is allowed to oscillate towards and away from the deck without imparting substantial movement upon the deck.

Figure 8:
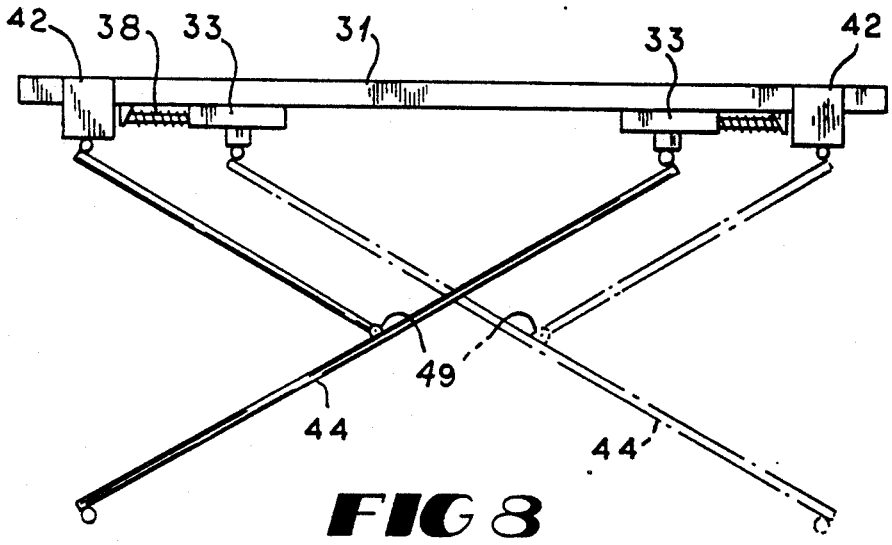
FIG. 8 is a schematic rear elevational view of the front suspension system assembly shown in a raised configuration.

As best shown in FIGS. 7–9, the raising of the deck and the oscillation of the hulls does not impart lateral movement upon the hulls towards or away from each other. For purposes of clarity an arm 44 and a strut 50 of the assembly are shown in these figures in phantom lines. The absence of lateral movement is an important factor in catamaran stability and performance, for non-parallel hulls tend to increase drag and disrupt boat tracking. This is achieved by pivotably mounting the strut 50, which preferably has a length equal to one half the length of the arm, to the center of the arm 44. Constructed in this manner the strut and a portion 75 of the arm located between the pivot bracket 49 and the pivot joint 40 move relative to each other in a scissor like action with the end of the strut that is mounted to pivot joint 43 remaining vertically aligned with the end of the arm 44 mounted to pivot joint 46.

This construction also aids in maintaining the deck level, for the strut and a portion 76 of the arm between the pivot bracket 49 and the pivot joint 46 also move relative to each other in a scissor like action. The end of the strut mounted to pivot joint 43 remains laterally aligned with the end of arm 44 mounted to pivot joint 40 so as not to cause one side of the deck to lower with respect to the opposite side of the deck, i.e. does not cause the deck to roll. However, upward movement of the hull throughout compression of the shock absorber and spring is transferred to both sides of the deck to minimize listing.

Since the rear of each hull is coupled to each other and to the motor pod, it is preferable that the components of the rear assembly move in unison to aid in maintaining the rear deck level and to reduce stress. Therefore, the carriages 33 of the rear suspension assembly 30 are coupled to each other through cable 58 to synchronize their movement. Movement of one carriage imparts an equal amount of movement in the other carriage along the track in the opposite direction by movement of cable 58.

Figure 3A:
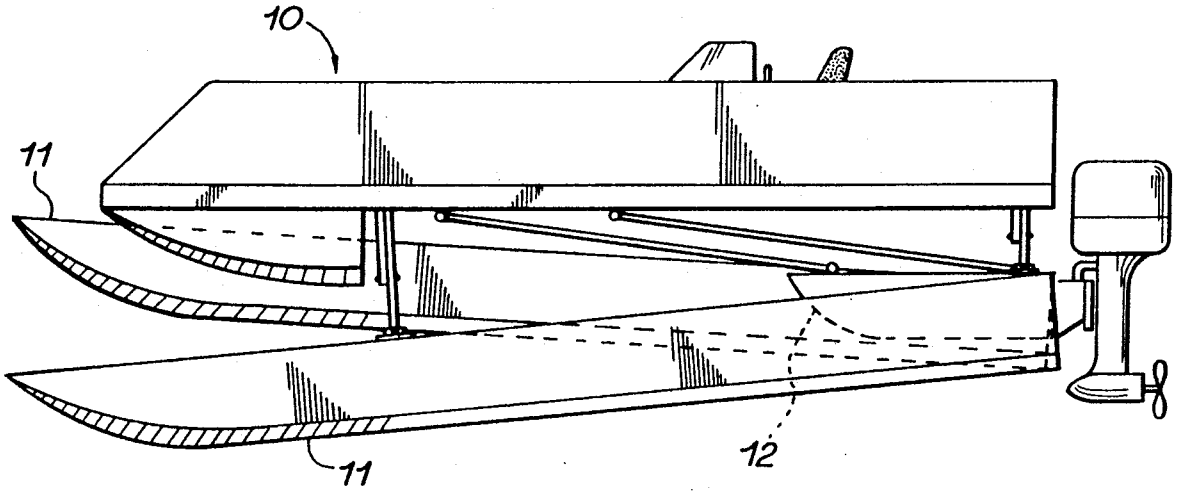
Figure 3B:
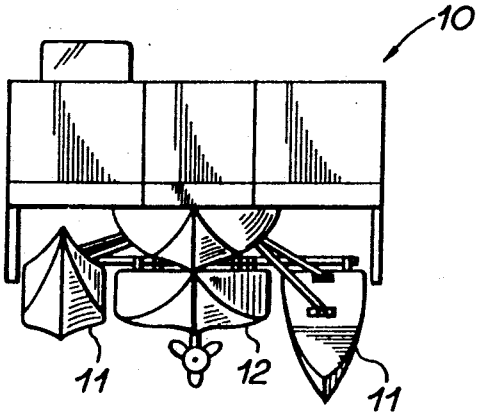
FIG. 3B is a front view thereof.

As the catamaran moves through rough water the hulls longitudinally cant with respect to the deck, as shown in FIGS. 3A and 3B. To allow for this canting the suspension system incorporates pivotable joints 40, 43 and 46 which permits the arms and struts to pivot with respect to the hull and deck. Forward and rearward pivotably movement of these joints are limited to prevent the deck from falling onto the hulls by connecting rods 68 and 71 which couple the deck to the hulls and motor pod. The connecting rods also prevent the motor pod from porpoising by maintaining the motor pod parallel with the deck.

An added advantage of the suspension system is that the deck may be raised to a higher level above the surface of the water than a conventional catamaran to give the driver of the boat a better view of the surrounding water.

As an alternative, a motor may be mounted to each hull to avoid the necessity of the motor pod. In such a case each hull is connected to the deck through a connecting rod 71. If desired, the suspension system may also be incorporated into a single hull type boat.

From the foregoing it is seen that a catamaran suspension system is now provided which overcomes problems long associated with those of the prior art. It should be understood however that the just described embodiment merely illustrates principles of the invention in its preferred form. Many modifications, additions and deletions may, in addition to those expressly recited, be made thereto without departure from the spirit and scope of the invention as set forth in the following claims.

I claim:

1. An improved suspension system for a catamaran having two hulls and a deck, said suspension system comprising guide means adapted to be mounted to the deck, first and second carriages movably mounted upon said guide means, limiting means for limiting movement of said carriages upon said guide means, shock absorbing means for absorbing force exerted upon said carriages as they are driven towards said limiting means, a first elongated arm adapted to be pivotably mounted at one end to one hull and pivotably mounted at an opposite end to said first carriage, a second elongated arm adapted to be pivotably mounted at one end to the other hull and pivotably mounted at an opposite end to said second carriage, a first strut pivotably mounted at one end to said one arm and pivotably mounted at an opposite end to said deck, and a second strut pivotably mounted at one end to said second arm and pivotably mounted at an opposite end to said deck.

2. The suspension system of claim 1 wherein said guide means comprises a track.

3. The suspension system of claim 2 wherein said first and second carriages are both mounted to said track.

4. The suspension system of claim 1 further comprising connecting means for connecting said first and second carriages to each other for synchronized moment along said guide means.

5. A catamaran comprising two laterally spaced hulls, a deck, a motor pod positioned between said hulls and at least one connecting rod pivotably mounted at one end to said motor pod and pivotably mounted at an opposite end to said deck, guide means mounted to said deck, first and second carriages movably mounted upon said guide means, limiting means for limiting movement of said carriages upon said guide means, shock absorbing means for absorbing force exerted upon said carriages as they are driven towards said limiting means, a first elongated arm adapted to be pivotably mounted at one end to one said hull and pivotably mounted at an opposite end to said first carriage, a second elongated arm adapted to be pivotably mounted at one end to the other said hull and pivotably mounted at an opposite end to said second carriage, a first strut pivotably mounted at one end to said one arm and pivotably mounted at an opposite end to said deck, and a second strut pivotably mounted at one end to said second arm and pivotably mounted at an opposite end to said deck.

6. A catamaran comprising two laterally spaced hulls, a deck, a track mounted to said deck, first and second carriages movably mounted upon said track, limiting means for limiting movement of said carriages upon said track, shock absorbing means for absorbing force exerted upon said carriages as they are driven towards said limiting means, a first elongated arm adapted to be pivotably mounted at one end to one said hull and pivotably mounted at an opposite end to said first carriage, a second elongated arm adapted to be pivotably mounted at one end to the other said hull and pivotably mounted at an opposite end to said second carriage, a first strut pivotably mounted at one end to said one arm and pivotably mounted at an opposite end to said deck, and a second strut pivotably mounted at one end to said second arm and pivotably mounted at an opposite end to said deck.

7. The catamaran of claim 6 wherein said first and second carriages are both mounted to said track.

8. The catamaran of claim 7 further comprising connecting means for connecting said carriages to each other for synchronized moment along said guide means.

* * * * *